US010605440B2

(12) United States Patent
Dorman et al.

(10) Patent No.: US 10,605,440 B2
(45) Date of Patent: Mar. 31, 2020

(54) HANGING LIGHT

(71) Applicant: MILWAUKEE ELECTRIC TOOL CORPORATION, Brookfield, WI (US)

(72) Inventors: Justin D. Dorman, Wauwatosa, WI (US); Alan Amundson, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 16/150,682

(22) Filed: Oct. 3, 2018

(65) Prior Publication Data

US 2019/0113212 A1 Apr. 18, 2019

Related U.S. Application Data

(60) Provisional application No. 62/571,985, filed on Oct. 13, 2017.

(51) Int. Cl.

| | |
|---|---|
| ***F21V 21/08*** | (2006.01) |
| ***F21L 14/02*** | (2006.01) |
| ***F21V 29/70*** | (2015.01) |
| ***F21V 29/505*** | (2015.01) |
| ***F21V 29/507*** | (2015.01) |
| ***F21V 3/02*** | (2006.01) |
| ***F21Y 115/10*** | (2016.01) |

(52) U.S. Cl.

CPC ..... *F21V 21/08* (2013.01); *F21L 14/02* (2013.01); *F21V 3/02* (2013.01); *F21V 29/505* (2015.01); *F21V 29/507* (2015.01); *F21V 29/70* (2015.01); *F21Y 2115/10* (2016.08)

(58) Field of Classification Search

CPC ..... F21L 14/02; F21L 2003/00; F21V 21/08; F21V 29/503; F21V 29/70; F21V 21/0885; F21V 21/406; F21Y 2115/10

See application file for complete search history.

(56) References Cited

U.S. PATENT DOCUMENTS

| | | | | |
|---|---|---|---|---|
| 2,156,742 A * | 5/1939 | Shellabarger | ..... | F21V 17/02 362/184 |
| 2,627,834 A | 2/1953 | Roberts et al. | | |
| 2,836,870 A | 6/1958 | Shea | | |

(Continued)

FOREIGN PATENT DOCUMENTS

| | | |
|---|---|---|
| GB | 2263726 | 8/1993 |

OTHER PUBLICATIONS

Construction Electrical Products, "LED High Bay Light", Accessed: Mar. 9, 2016, <http://www.cepnow.com/product/led-high-bay-light/>.

(Continued)

*Primary Examiner* — Peggy A Neils

(74) *Attorney, Agent, or Firm* — Michael Best & Friedrich LLP

(57) ABSTRACT

A portable lighting device includes a body, a lighting unit supported by the body, a frustoconically-shaped lens coupled to the body and surrounding the lighting unit, a terminal block supported by the body, and a hanging cable configured to hang the body from a support structure. The lighting unit includes a light emitting diode and a heat sink. The terminal block is configured to connect to a power source and provide electrical energy to the lighting unit to illuminate the light emitting diode.

17 Claims, 8 Drawing Sheets

(56) References Cited

U.S. PATENT DOCUMENTS

| | | | | |
|---|---|---|---|---|
| 3,265,032 | A | 8/1966 | Hume | |
| 3,730,129 | A | 5/1973 | Helms | |
| 3,765,061 | A | 10/1973 | Nash | |
| 3,795,218 | A | 3/1974 | Merry | |
| 4,217,847 | A | 8/1980 | McCloud | |
| 4,397,253 | A | 8/1983 | Uecker et al. | |
| 4,453,486 | A | 6/1984 | Harken | |
| 4,956,897 | A | 9/1990 | Speedie | |
| D391,000 | S | 2/1998 | Markee | |
| 6,234,653 | B1 | 5/2001 | Karton | |
| 6,296,369 | B1 * | 10/2001 | Liao | B60Q 7/00 362/186 |
| D464,454 | S | 10/2002 | Suzuki et al. | |
| 6,517,222 | B1 | 2/2003 | Orlov | |
| 6,761,342 | B1 | 7/2004 | Giefer et al. | |
| 6,767,116 | B2 | 7/2004 | Lupicki | |
| 6,767,117 | B2 | 7/2004 | De'Armond | |
| 7,019,210 | B2 | 3/2006 | Radin | |
| 7,287,304 | B2 | 10/2007 | Zebe, Jr. | |
| 7,347,582 | B1 * | 3/2008 | Kung | F21L 4/00 362/177 |
| D565,766 | S | 4/2008 | Shiu | |
| D574,993 | S | 8/2008 | Silver | |
| 7,784,964 | B2 * | 8/2010 | Yen | F21L 4/04 362/188 |
| 7,866,850 | B2 * | 1/2011 | Alexander | F21V 19/001 362/294 |
| 8,164,237 | B2 | 4/2012 | Wen | |
| D711,572 | S | 8/2014 | Kwon et al. | |
| 9,028,112 | B2 * | 5/2015 | Ellenburg | F21V 21/08 362/191 |
| 9,033,550 | B1 | 5/2015 | Tickner | |
| D759,284 | S | 6/2016 | De Bevilacqua et al. | |
| 9,447,934 | B2 * | 9/2016 | Kim | F21L 19/00 |
| D773,703 | S | 12/2016 | Krantz et al. | |
| D773,704 | S | 12/2016 | Pardo et al. | |
| 9,599,312 | B2 * | 3/2017 | Chen | F21L 4/00 |
| D783,872 | S | 4/2017 | Aksnes | |
| D787,104 | S | 5/2017 | Wu | |
| D824,077 | S | 7/2018 | Davis et al. | |
| 10,422,512 | B2 * | 9/2019 | Seward | F21V 21/08 |
| D861,956 | S | 10/2019 | Preutz | |
| 2007/0041209 | A1 | 2/2007 | Glass | |
| 2007/0139921 | A1 | 6/2007 | Wu | |
| 2007/0246631 | A1 | 10/2007 | Brown et al. | |
| 2007/0278376 | A1 | 12/2007 | Townsend, Jr. | |
| 2008/0218992 | A1 * | 9/2008 | Li | F21V 1/00 362/84 |
| 2009/0290364 | A1 | 11/2009 | Thomas et al. | |
| 2011/0317418 | A1 * | 12/2011 | Burrell, IV | F21V 19/0045 362/241 |
| 2013/0279180 | A1 | 10/2013 | Pearson et al. | |
| 2015/0040814 | A1 | 2/2015 | Volkwein | |

OTHER PUBLICATIONS

Garvin Industries, "LED Temporary Job Site Light", Accessed: Mar. 9, 2016, <http://www.garvinindustries.com/lighting/led-temp-lights>.

ProBuilt Lighting, "Hang-A-Light LED", Accessed: Mar. 9, 2016, <http://probuiltlighting.com/products/hang-a-light-led/>.

ProBuilt Lighting, "Hang-A-Light 200 Watt LED", Accessed: Mar. 9, 2016, <http://probuiltlighting.com/hal-200-watt-led/>.

United States Patent Office Action for U.S. Appl. No. 29/628,064 dated Oct. 18, 2019 (8 pages).

* cited by examiner

HANGING LIGHT

CROSS-REFERENCE TO RELATED APPLICATIONS

This application claims priority to U.S. Provisional Application No. 62/571,985, filed on Oct. 13, 2017, the entire contents of which are incorporated by reference.

FIELD OF INVENTION

The present invention relates to portable lighting devices and, more particularly, to hanging lights.

SUMMARY

The present invention may provide, in an independent aspect, a portable lighting device including a body and a lighting unit supported by the body. The lighting unit includes a light emitting diode and a heat sink. The portable lighting device also includes a frustoconically-shaped lens coupled to the body and surrounding the lighting unit, and a terminal block supported by the body. The terminal block is configured to connect to a power source and provide electrical energy to the lighting unit to illuminate the light emitting diode. The portable light device further includes a hanging cable configured to hang the body from a support structure.

The present invention may provide, in another independent aspect, a portable lighting device including a body and a lighting unit supported by the body. The lighting unit includes a light emitting diode and a heat sink. The portable lighting device also includes a lens coupled to the body and surrounding the lighting unit. The lens includes a top portion, a middle portion, and a flat bottom. The top portion completely surrounds the heat sink and is coupled to the body. The middle portion tapers from the top portion to the flat bottom. The portable lighting device further includes a terminal block supported by the body. The terminal block is configured to connect to a power source and provide electrical energy to the lighting unit to illuminate the light emitting diode. The portable lighting device also includes a hanging cable configured to hang the body from a support structure.

The present invention provides, in another independent aspect, a portable lighting device including a body having an interior cavity and a lighting unit supported by the body. The lighting unit includes a light emitting diode and a heat sink. The heat sink has a body portion coupled to the body and a cone portion that tapers from the body portion to a bottom portion of the heat sink. The light emitting diode is supported on the bottom portion of the heat sink. The portable lighting device also includes a frustoconically-shaped lens coupled to the body and surrounding the lighting unit. The frustoconically-shaped lens includes a top portion, a middle portion, and a flat bottom. The top portion completely surrounds the heat sink and is coupled to the body. The middle portion tapers from the top portion to the flat bottom. The portable lighting device further includes a terminal block supported by the body within the interior cavity. The terminal block is configured to connect to a power source and provide electrical energy to the lighting unit to illuminate the light emitting diode. The portable lighting device also includes a hanging cable configured to hang the body from a support structure.

Other independent features and independent aspects of the invention may become apparent by consideration of the following detailed description and accompanying drawings.

DETAILED DESCRIPTION

Figure 1:
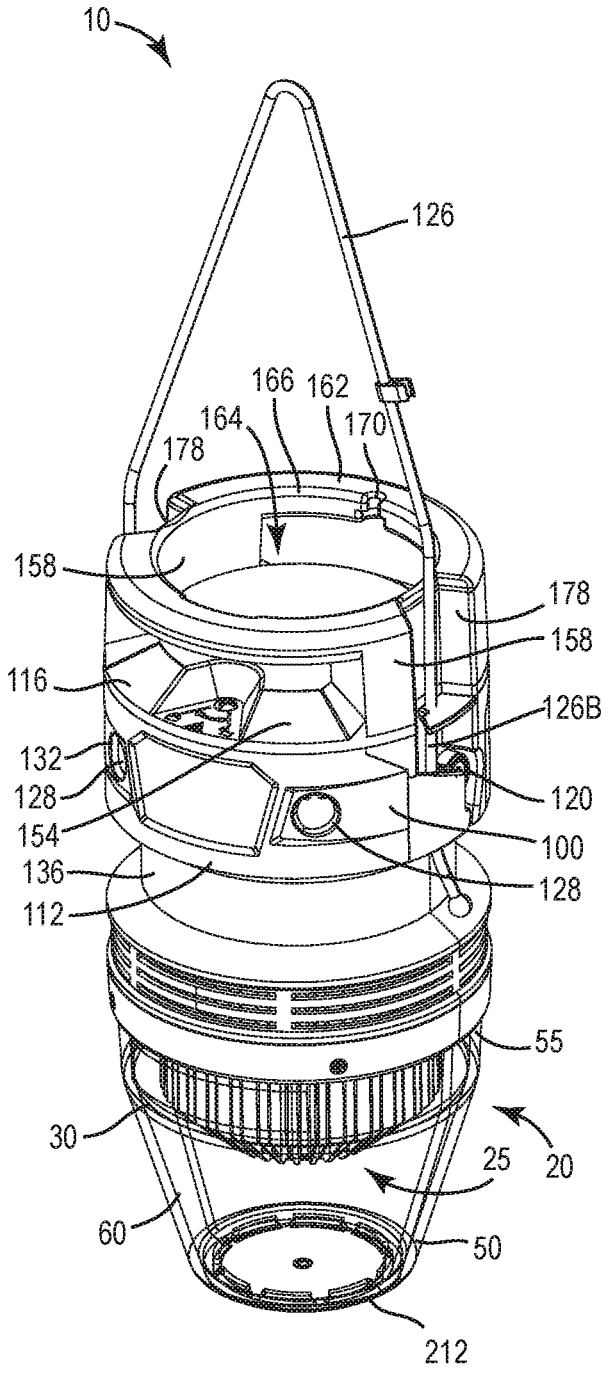
FIG. 1 is a perspective view of a portable lighting device.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

FIGS. 1-8 illustrate a portable lighting device 10, such as, for example, a high bay light or work light used at construction sites. The illustrated lighting device 10 includes a lighting unit 20, a lens 50, and a body 100. The lighting device 10 is designed to be portable and optionally includes features to allow a user to hang the lighting device 10 from another object, such as an overhead beam, rafter, pipe, etc.

The lighting unit 20 is supported by the body 100. As shown in FIGS. 1-4, the lighting unit 20 extends downwardly from the body 100 in an axial direction. In the illustrated embodiment, the lighting unit 20 includes a heat sink 30 with an interior cavity 35 (FIG. 4) that houses a plurality of light emitting diodes (LEDs) 25, which may optionally be disposed along a plurality of LED strips. The LEDs 25 are positioned in the cavity near the bottom, if viewed from the hanging orientation, of the heat sink 30. In other embodiments, the LEDs 25 of the lighting unit 20 may be arranged in other configurations, or the lighting unit 20 may include a single LED. In further embodiments, the LEDs 25 may be chip on board (COB) LEDs that include more diodes.

Figure 2:
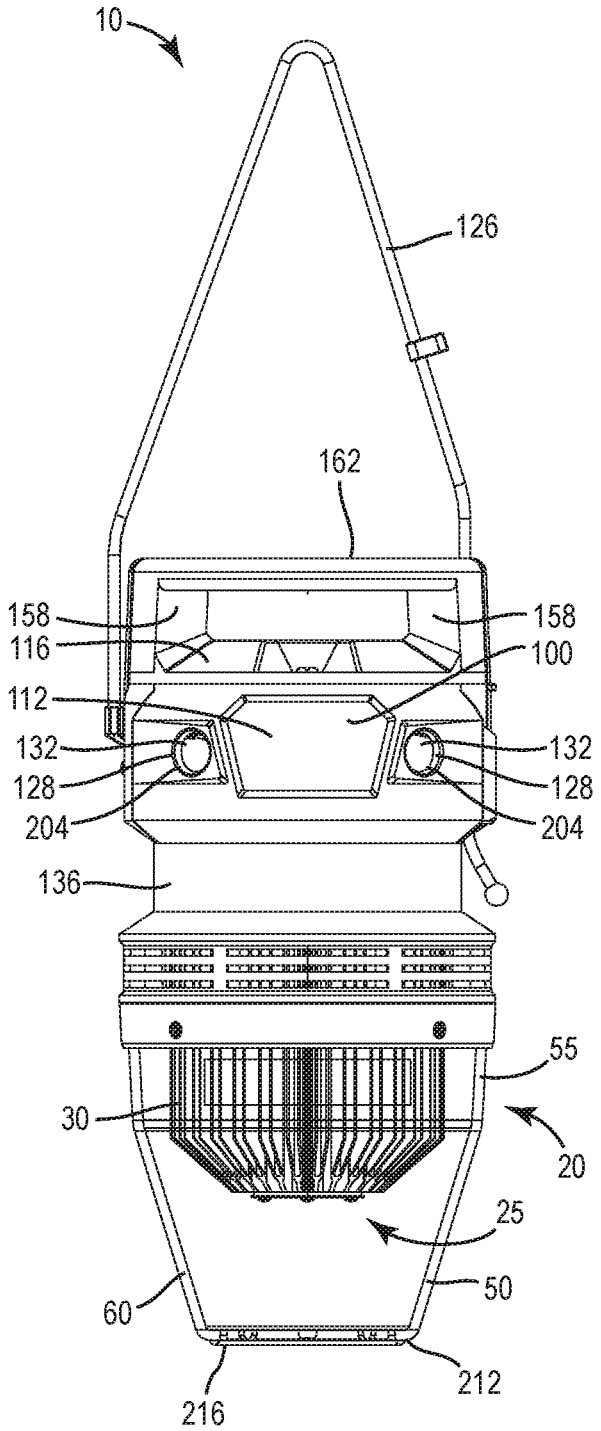
FIG. 2 is a side view of the portable lighting device of FIG. 1.
Figure 3:
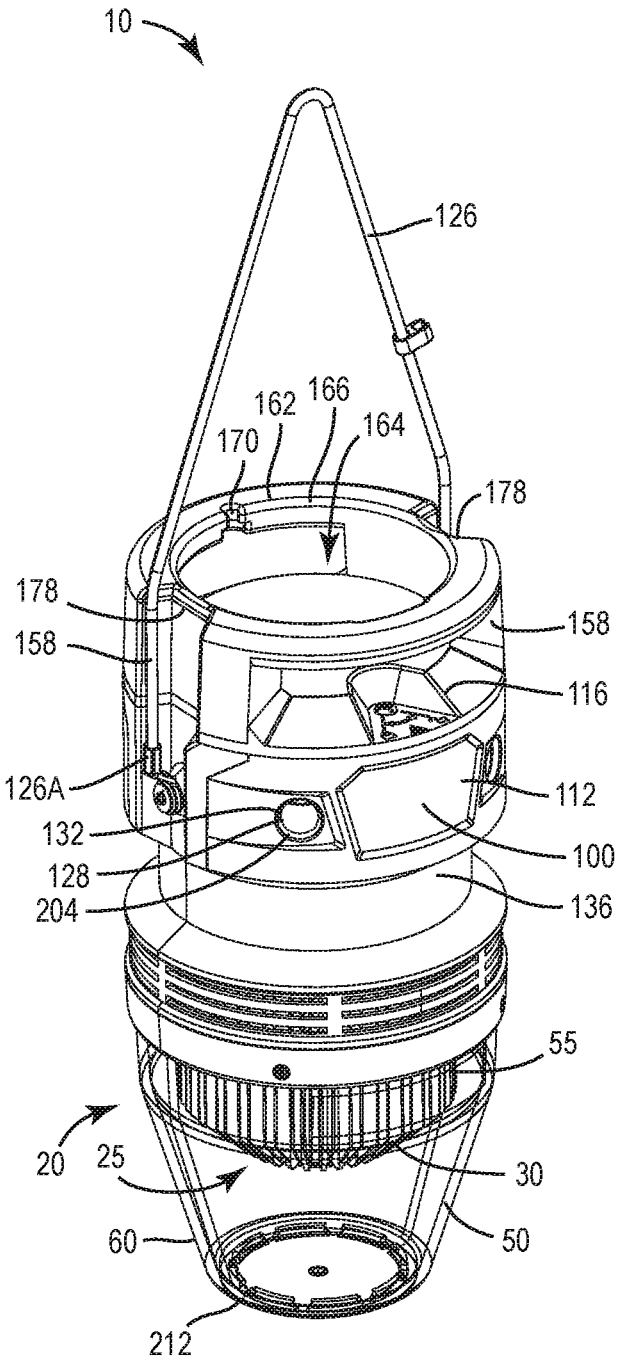
FIG. 3 is another perspective view of the portable lighting device of FIG. 1.
Figure 4:
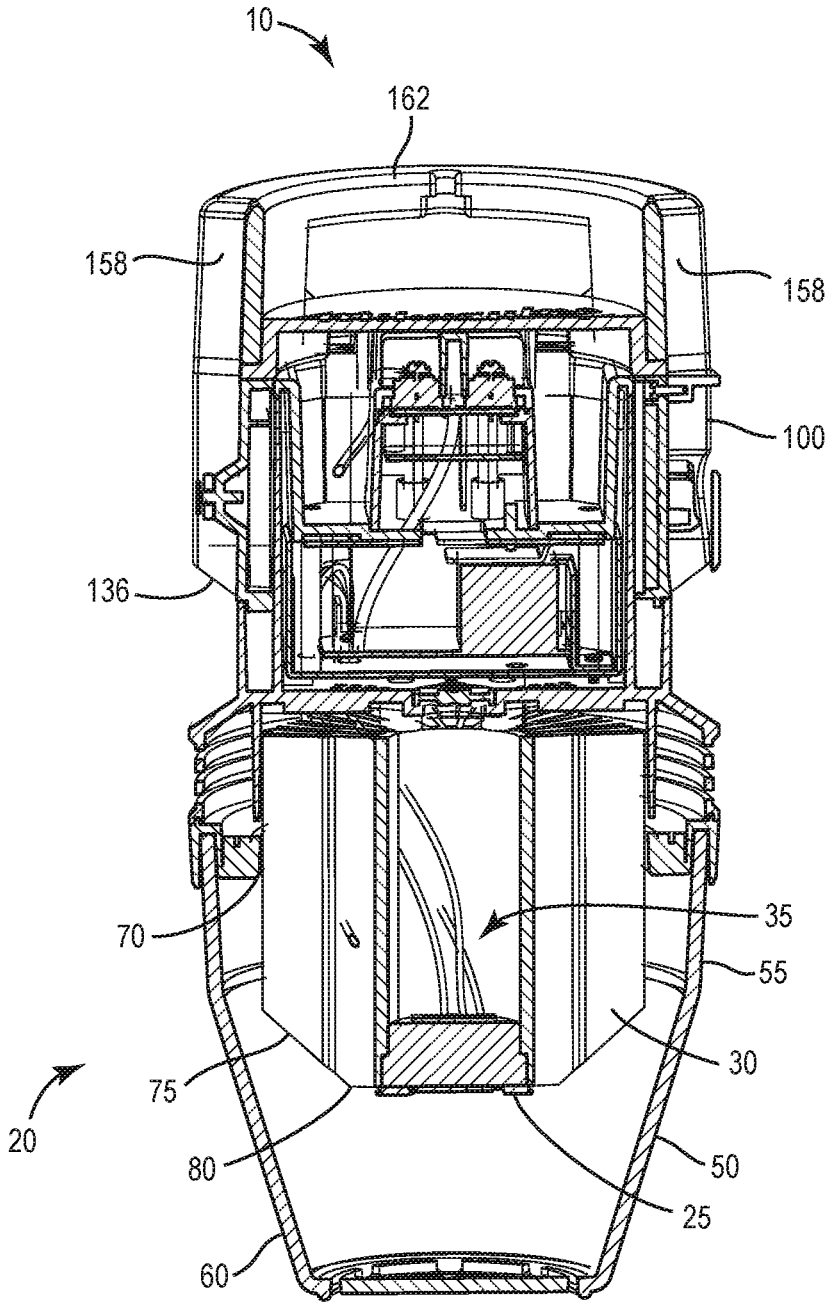
FIG. 4 is a cross-sectional view of the portable lighting device of FIG. 1

With continued reference to FIGS. 1-3, the lens 50 is coupled to the body 100 and surrounds the lighting unit 20. In the illustrated embodiment, the lens 50 and the body 100 completely enclose the lighting unit 20. In other embodiments, the lens 50 may include gaps or apertures such that the lighting unit 20 is not completely enclosed. The lens 50 contains and protects the lighting unit 20, while also acting to diffuse light emitted by the lighting unit 20. In some embodiments, the lens 50 is constructed from a plastic, such as high density polyethylene (HDPE). In other embodiments, the lens 50 may be constructed from other materials (e.g., different plastics, glass, etc.).

The illustrated lens 50 is also detachably coupled to the body 100, allowing the lens 50 to be easily cleaned and/or replaced. In some embodiments, the lens 50 may be threadably coupled to the body 100. In other embodiments, the lens 50 may be detachably coupled to the body 100 in other suitable manners (e.g., press fitting, detents, bayonet couplings, etc.).

In the illustrated embodiment, the lens 50 is frustoconically-shaped and includes a top portion 55, a middle portion 60, and a flat bottom 212. The top portion 55 completely surrounds the heat sink 30 and is coupled to the body 100. The middle portion 60 of the lens 50 tapers from the top portion 55 to the flat bottom 212. In other words, the cross-sectional diameter of the middle portion 60 of the lens 50 decreases as it extends away from the body 100.

Figure 5:
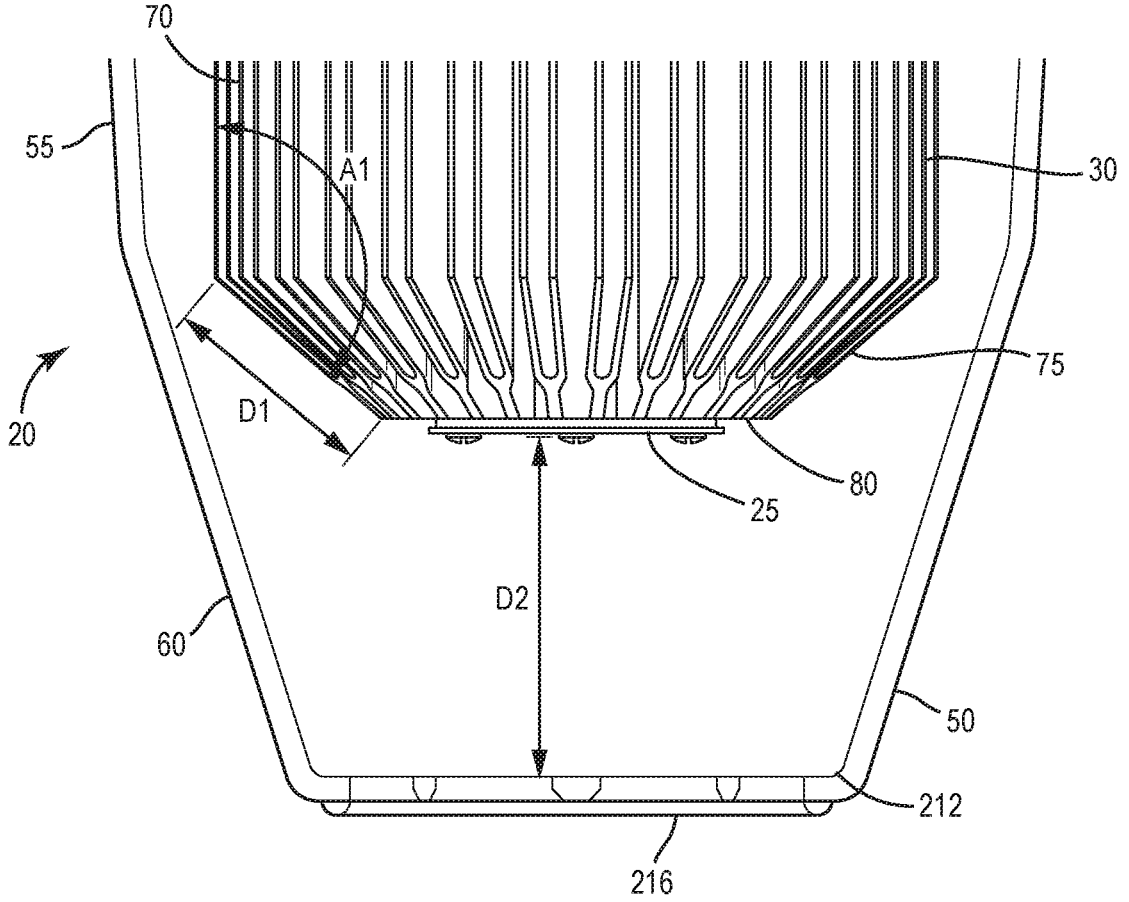
FIG. 5 is a side view of a portion of the portable lighting device of FIG. 1 detailing a frustoconically-shaped lens.

The heat sink 30 is also frustoconically shaped, and includes a body portion 70 coupled to the body 100 and a cone portion 75 that tapers from the body portion to a bottom portion 80 of the heat sink 30. With reference to FIG. 5, in the illustrated embodiment, the cone portion 75 and the body portion 70 of the heat sink 30 define an angle A1 of approximately 130 degrees. In other words, the cone portion 75 extends inwardly at an angle of about 50 degrees from the vertical. In other embodiments, the angle A1 is within the range of about 95 degrees to about 175 degrees.

In the illustrated embodiment, a distance D1 defined by the cone portion 75 between the body portion 70 and the bottom portion 80 could be 1.42 inches, and a distance D2 defined between the bottom portion 80 of the heat sink 30 and the flat bottom 212 of the lens 50 could be 2.23 inches. As illustrated, the ratio of the distance D1 to the distance D2 is about 1:1.57. In other embodiments, the ratio of the distance D1 to the distance D2 could be lower or higher, as described below. Preferably, the ration of D1 to D2 is within a range of 3:5 and 2:3

Figure 6:
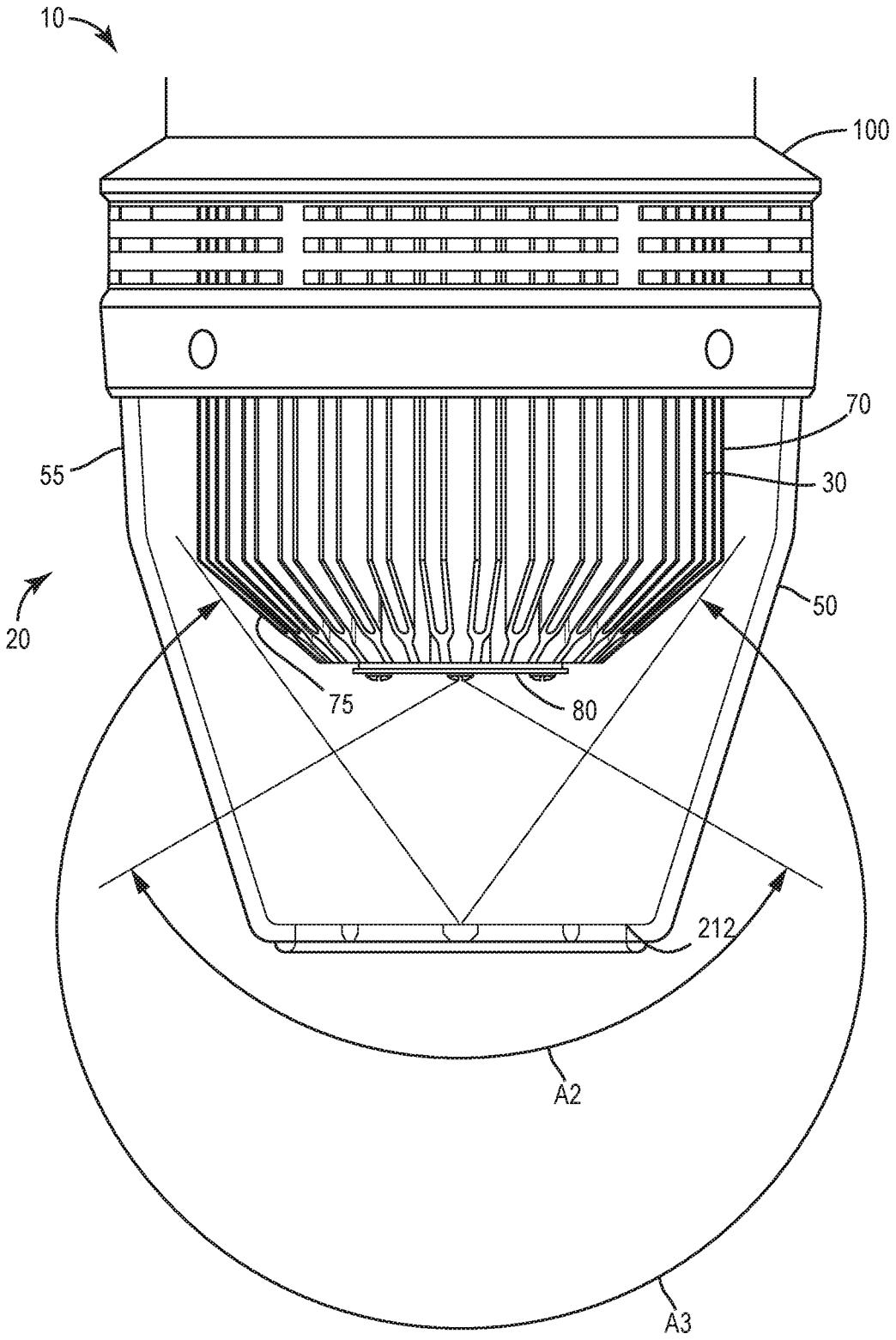
FIG. 6 is a side view of a lighting unit on the portable lighting device of FIG. 1.

With reference to FIG. 6, in the illustrated embodiment, light extends vertically from the cone of the LEDs 25 within an angle A2 of 120 degrees from a center of the bottom portion 80 of the heat sink 30. In other words, light extends vertically from the LEDs at approximately 30 degrees from the horizontal. Additionally, a single LED may have a degree dispersion angle within a range of 120 degrees. The illustrated frustoconical shape of the lens 50 allows for light rays to extend vertically from the LEDs 25 and reflect back vertically out the lens 50.

With continued reference to FIG. 6, with the frustoconically-shaped heat sink 30, light produced by the LEDs 25 may reflect off the frustoconical lens 50 and pass the heat sink 30 in a vertical direction and, thus, illuminate areas above the LEDs 25 and above the portable lighting device 10. In the illustrated construction, light produced from the LEDs illuminates an area within an angle A3 of approximately 287 degrees from the center of the bottom 212 of the lens 50. In contrast, with a cylindrical heat sink, the heat sink would block light that passes the cone portion 75 to reduce the area of illumination.

In other embodiments, the area of illumination or angle A3 can be increased by increasing the distance D2 between the LEDs 25 and the bottom 212 of the lens 50 and/or by decreasing the size of the heat sink 30 (e.g., the diameter of the body portion 70). In such embodiments, the area of illumination may only be maximized to cover to the outer edge of the body 100. As such, in other embodiments, the angle A3 may be within a range of 270 degrees and 300 degrees.

Figure 8:
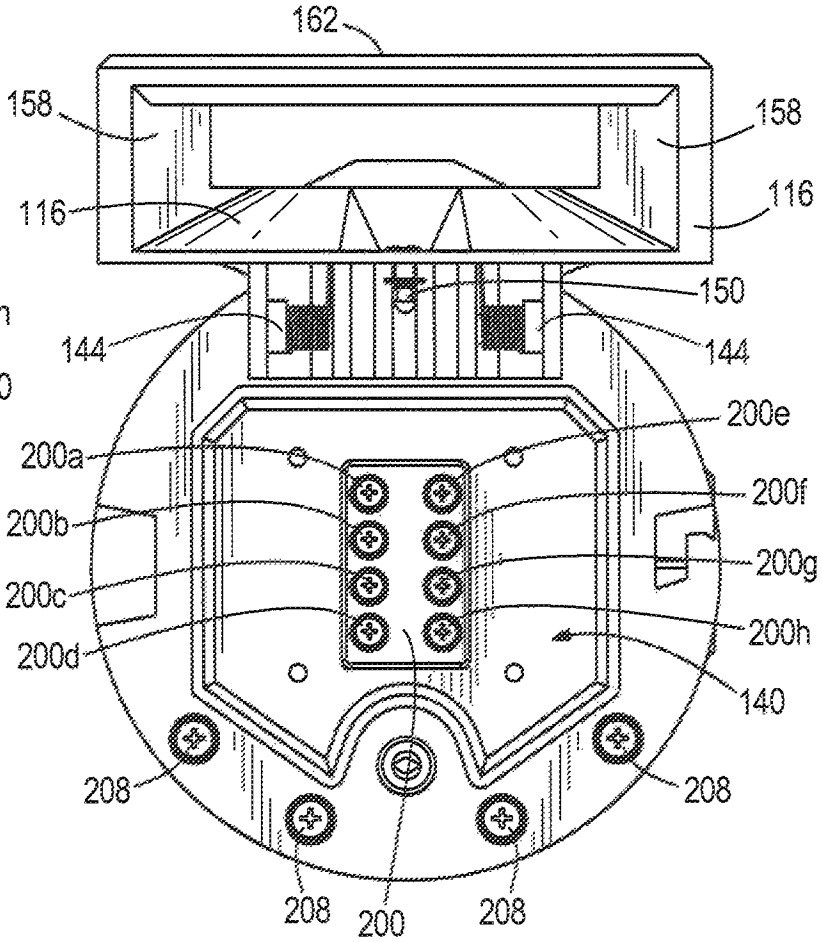
FIG. 8 is a top view of the body of the portable lighting device of FIG. 7 with the cover in the open position.
Figure 7:
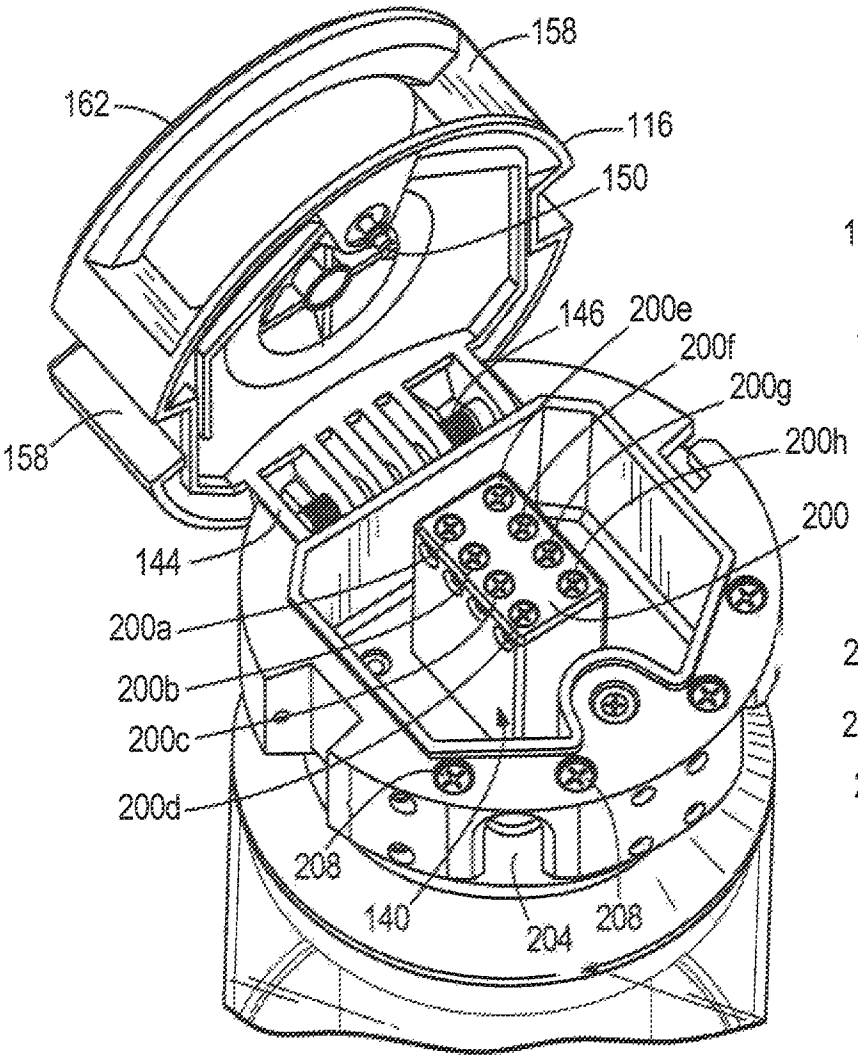
FIG. 7 is a top perspective view of a body of the portable lighting device of FIG. 1 with a cover in an open position.

Referring back to FIGS. 1-3, the illustrated body 100 is generally cylindrically-shaped and includes a base 112, a cover 116, and an annular rim 162. The base 112 is coupled to the lens 50. The base 112 includes a reduced diameter portion 136, or neck, between the cover 116 and the lens 50. The reduced diameter portion 136 allows an excess length of hanging cable or electrical wire to be wrapped and stored around the body 100. As shown in FIGS. 7 and 8, the base 112 also has an interior cavity 140 that receives a terminal block 200. Two ports 128 (FIG. 2) are formed in the base 112 in communication with the interior cavity 140. As further described below, the ports 128 allow electrical wires to pass into the interior cavity 140 to couple to the terminal block 200.

Figure 9:
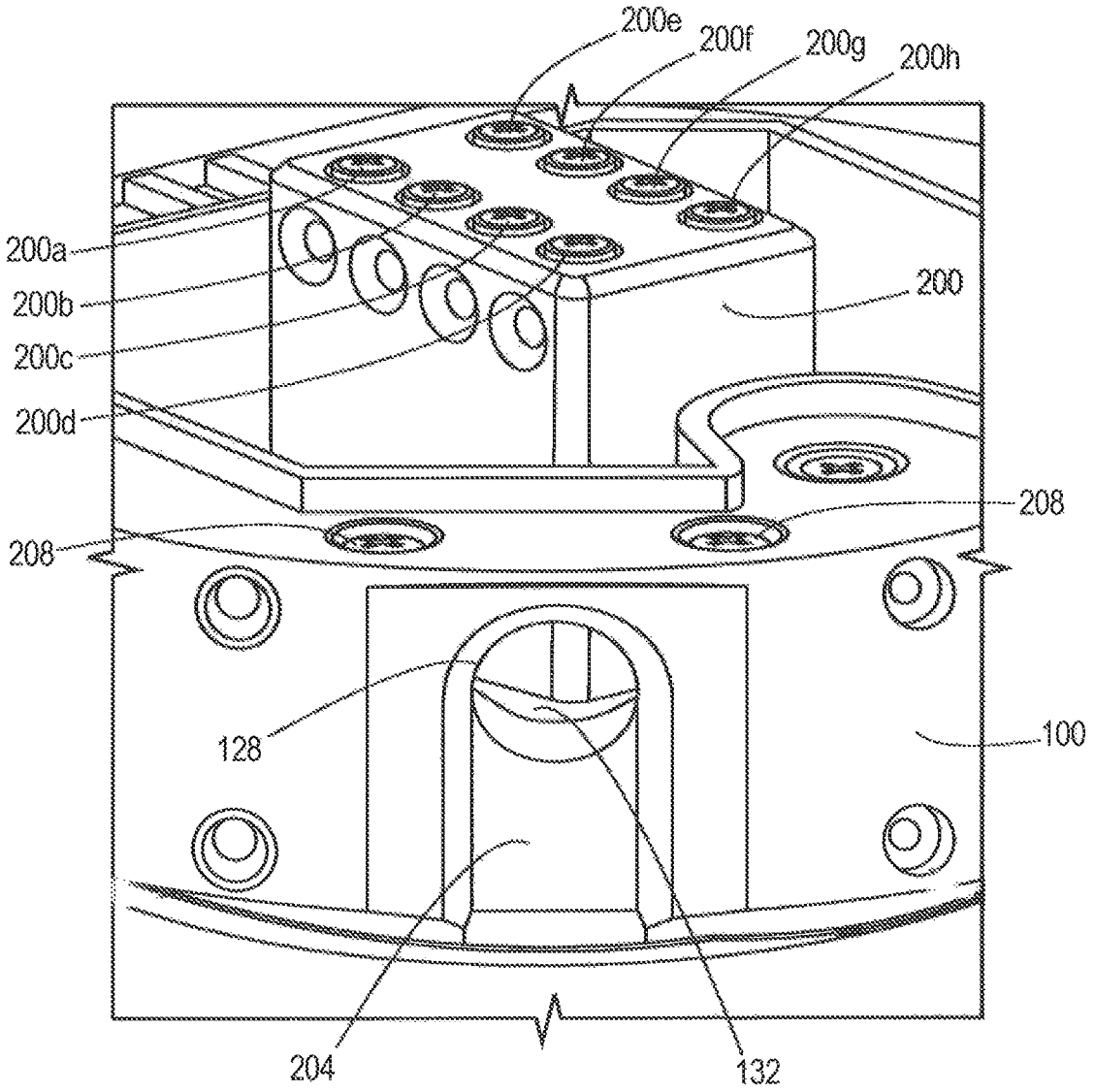
FIG. 9 is an enlarged perspective view of a terminal block of the portable lighting device.

The cover 116 is movably coupled to the base 112 for movement between a closed configuration (FIGS. 1-3) and an open configuration (FIGS. 7-9). The cover 116 encloses the interior cavity 140 of the base 112 when in the closed configuration. As shown in FIGS. 7 and 8, the cover 116 is pivotally coupled to the base 112 by a hinge 144. The hinge 144 allows the cover 116 to pivot to the open configuration. In some embodiments, such as the illustrated embodiment, the cover 116 is biased to the open configuration by one or more springs 146 (e.g., torsion springs).

However, the cover 116 also includes a locking mechanism 150 to maintain the cover 116 in the closed configuration against the bias of the spring(s) 146. In the illustrated embodiment, the locking mechanism 150 includes a quarter-turn fastener that may be rotated by a user with, for example, a screw driver to unsecure the locking mechanism 150 from the base 112. In other embodiments, other types of detachable coupling mechanisms (e.g., push button latches, ball detents, etc.) that may or may not require tools to actuate may alternatively be used to hold the cover 116 in the closed configuration. In some embodiments, a gasket may be positioned between the cover 116 and the base 112 to seal the interior cavity 140 when the cover 116 is closed.

As shown in FIGS. 1-3, the annular rim 162 is supported by the cover 116 above the base 112. In the illustrated embodiment, two posts 158 extend upwardly from the cover 116 to support the rim 162. The annular rim 162 defines a generally circular opening 164 in the body 100. The rim 162 has a chamfered interior edge 166 that defines the opening 164. The rim 162 also includes a notch 170 formed in the interior edge 166. The notch 170 is configured to receive a fastener, such as a nail, to hang the lighting device 10 from a support structure, such as a wall. The annular rim 162 also includes two channels 178 formed in an outer surface of the rim 162. The channels 178 extend continuously through the posts 158 and an outer surface of the cover 116. As further explained below, the channels 178 are configured to receive portions of a hanging cable 126 to help guide the cable 126.

With continued reference to FIGS. 1-3, the illustrated lighting device 10 includes a hanging cable 126 coupled to the body 100. The hanging cable 126 is configured to hang the lighting device 10 from a support structure, such as an overhead beam, rafter, or pipe. The hanging cable 126 includes a first end 126A (FIG. 3) secured to the body 100 by a pin, rivets, a hook, etc. The hanging cable 126 also includes a second end portion 126B (FIG. 1) opposite from the first end 126A and adjustably coupled to a cable clamp mechanism 120 of the lighting device 10.

The cable clamp mechanism 120 is supported by the body 100 at a location diametrically opposite from where the first end 126A of the cable 126 is secured to the body 100. In particular, the cable clamp mechanism 120 is aligned with one of the channels 178, and the first end 126A of the cable 126 is secured in the other channel 178. This arrangement allows the hanging cable 126 to be extended over the cover 116 to form a loop for hanging the lighting device 10. The cable clamp mechanism 120 also allows the length of the cable 126 between the secured first end 126A and the cable clamp mechanism 120 to be adjusted (e.g., increased or decreased) by pulling the second end portion 126B of the cable 126 through or releasing the second end portion 126B of the cable 126 from the cable clamp mechanism 120. Adjusting the length of the cable 126 changes the size of the loop formed by the hanging cable 126. Excess length of the hanging cable 126 can be wrapped around the reduced diameter portion 136 of the base 112 for storage.

FIGS. 7-9 illustrate the cover 116 in an open configuration to expose the terminal block 200. The terminal block 200 includes a plurality of screw terminals for connecting electrical wires to the lighting device 10. In the illustrated embodiment, the terminal block 200 includes eight terminals 200*a-h* arranged as two sets of four terminals.

One set of terminals 200*a-c* acts as a power input, and includes a power in terminal 200*a*, a ground terminal 200*b*, and neutral terminal 200*c*. These terminals 200*a-c* are electrically coupled to an external power source via electrical wires and to the lighting unit 20 to power the LEDs 25. The other set of terminals 200*e-g* acts as a power output, and includes a power out terminal 200*e*, a ground terminal 200*f*, and a neutral terminal 200*g*. These terminals 200*e-g* allow a peripheral device, such as another portable lighting device, to be electrically coupled to and draw power from the lighting device 10. As such, multiple portable lighting devices 10 can be connected, or daisy-chained, together to form a string of lights that receive power from the same external power source.

The illustrated terminal block 200 also includes two pass-through screw terminals—an input terminal 200*d* and an output terminal 200*h*. The pass-through terminals 200*d*, 200*h* are configured to receive power from the external power source or a second external power source, and pass electricity through the terminal block 200. That is, electricity is passed directly through the lighting device 10 without being consumed or attenuated by the lighting device 10 (e.g., to power the lighting unit 20, etc.). Sufficient power can thereby be provided to downstream lights by the pass-through terminals 200*d*, 200*h* if, for example, many lights are strung together. Accordingly, one or more peripheral devices (including additional portable lighting units 10) may be connected to the lighting device 10 via either the output terminals 200*e-g* or the pass-through terminals 200*d*, 200*h*.

In one example, a plurality of lighting devices 10 may be electrically connected to a common power source via terminal blocks 200 disposed in each lighting device 10. If the first lighting device 10 is coupled to the external power source, and each subsequent lighting device 10 is coupled to the output terminals of an adjacent device 10, the number of lights that may be connected in series is limited by the power usage of each upstream device 10. In order to overcome this power consumption, the pass-through terminals 200*d*, 200*h* transfer power without significant usage or attenuation. Accordingly, a greater number of lighting devices 10 and/or other peripheral devices may be coupled in series.

Referring back to FIG. 2, the illustrated lighting device 10 includes two wire clamps 132 supported by the body 100 at the ports 128. The wire clamps 132 help secure the electrical wires to the lighting device 10, inhibiting the wires from being unintentionally pulled out of the terminal block 200. One of the ports 128 and clamps 132 are associated with the input terminals 200*a-d*, and the other port 128 and clamp 132 are associated with the output terminals 200*e-h*.

Each clamp 132 is associated with one of the ports 128 and includes a door 204 (FIG. 9). The doors 204 are movable (e.g., slidable) relative to the body 100 to open and close the ports 128. When the doors 204 are opened, the electrical wires may be inserted through or pulled out of the ports 128. When the doors 204 are closed, the doors 204 engage the electrical wires to hold the wires in place, thereby inhibiting disconnection of the wires from the terminal block 200.

Each wire clamp 132 also includes an adjustment member 208 coupled to the door 204. The adjustment member 208 is actuatable to move the door 204 relative to the body 100. As shown in FIGS. 7 and 8, the illustrated adjustment members 208 are screws that are operatively coupled to the doors 204. The screws 208 are rotatable to move the doors 204 up and down. In the illustrated embodiment, two screws 208 are associated with each door 204, and both screws 208 are rotated to move the door 204. In other embodiments, only one screw 208 may be used to move each door 204.

In further embodiments, other types of mechanisms may be used for moving the doors 204 relative to the body 100. For example, the doors 204 may be spring-biased closed and manually moved open, the doors 204 may be associated with switches that change their positions, or the doors 204 may include detents to hold the doors open and closed with handles to manually move the doors 204.

As shown in FIGS. 1-3, the lower portion 212 of the lens 50 is a boss or projection having a similar shape and size as the opening 164 defined by the annular rim 162. In addition, the lower portion 212 has a chamfered exterior edge 216 corresponding to the chamfered interior edge 166 of the annular rim 162. In this way, the lower portion 212 of the lens 50 of a first lighting device 10 may be received and seated in the opening 164 of a second lighting device 10 so that multiple lighting devices 10 may be stacked upon one another. The chamfered edges 166, 216 help the lighting devices 10 seat snugly on top of each other.

In operation, the device 10 may be hung on or otherwise connected to an external structure via the hanging cable 126 or notch 170. The lighting device 10 is also electrically coupled to a power source, such as a DC power source (e.g., a battery pack) or an AC power source (e.g., a standard 120V power outlet) via one or more electrical wires, to power the LEDs 25 of the lighting unit 20. The light emitted by the LEDs 25 passes through the lens 50, which diffuses light to provide light to a larger area and to provide more uniform lighting. Furthermore, additional lighting devices, or other peripheral devices, may be coupled to the lighting device 10 via the power outlet or the pass-through terminals as described above.

Although the invention has been described in detail with reference to certain preferred embodiments, variations and modifications exist within the scope and spirit of one or more independent aspects of the invention as described.

One or more independent features and/or independent advantages of the invention may be set forth in the claims

What is claimed is:

1. A portable lighting device comprising:

a body;

a lighting unit supported by the body, the lighting unit including a light emitting diode and a heat sink;

a frustoconically-shaped lens coupled to the body and surrounding the lighting unit;

a terminal block supported by the body, the terminal block configured to connect to a power source and provide electrical energy to the lighting unit to illuminate the light emitting diode; and a hanging cable configured to hang the body from a support structure, wherein the heat sink is frustoconically-shaped, wherein the heat sink includes a body portion coupled to the body and a cone portion that tapers from the body portion to a bottom portion of the heat sink, and wherein the frustoconically-shaped lens includes a top portion, a middle portion, and a flat bottom, wherein the top portion completely surrounds the heat sink and is coupled to the body, and wherein the middle portion tapers from the top portion to the flat bottom.

2. The portable lighting device of claim 1, wherein the lens is configured to reflect light emitted from the light emitting diode in an area above the portable lighting device.

3. The portable lighting device of claim 2, wherein the light emitted from the light emitting diode illuminates an area within an angle of 300 degrees from a center of a bottom of the lens.

4. The portable lighting device of claim 1, wherein the lighting unit extends downward from the body in an axial direction.

5. The portable lighting device of claim 4, wherein the light emitting diode is positioned on a bottom portion of the heat sink.

6. The portable lighting device of claim 1, wherein the lens is constructed from high density polyurethane.

7. The portable lighting device of claim 1, wherein an angle defined between the body portion and the cone portion of the heat sink is between 95 degrees and 175 degrees.

8. The portable lighting device of claim 1, wherein a ratio of a first distance defined by the length of the cone portion and a second distance between the bottom portion of the heat sink and the flat bottom of the lens is within a range between 3:5 and 2:3.

9. The portable lighting device of claim 1, further comprising a cable clamp mechanism supported by the body and engaged with the second end of the hanging cable to allow adjustment of a length of the cable.

10. The portable lighting device of claim 1, further comprising a cover that is movably coupled to the body for movement between a closed configuration and an open configuration.

11. The portable lighting device of claim 10, further comprising a locking mechanism configured to maintain the cover in the closed configuration.

12. The portable lighting device of claim 1, wherein the body includes an interior cavity, the portable lighting device further comprising a port formed in the body in communication with the interior cavity, the port configured to allow an electrical wire to pass into the interior cavity to couple the electrical wire to the terminal block.

13. The portable lighting device of claim 12, wherein the port includes a wire clamp mechanism configured to secure a wire in the port.

14. A portable lighting device comprising:

a body;

a lighting unit supported by the body, the lighting unit including a light emitting diode and a heat sink;

a lens coupled to the body and surrounding the lighting unit, the lens including a top portion, a middle portion, and a flat bottom, the top portion completely surrounds the heat sink and is coupled to the body, the middle portion tapers from the top portion to the flat bottom such that an outer dimension of the middle portion decreases as the middle portion extends away from the body;

a terminal block supported by the body, the terminal block configured to connect to a power source and provide electrical energy to the lighting unit to illuminate the light emitting diode; and a hanging cable configured to hang the body from a support structure.

15. The portable lighting device of claim 14, wherein a cross-sectional diameter of the middle portion decreases from the top portion to the flat bottom.

16. The portable lighting device of claim 14, wherein the heat sink is frustoconically-shaped.

17. A portable lighting device comprising:

a body including an interior cavity;

a lighting unit supported by the body, the lighting unit including a light emitting diode and a heat sink, the heat sink having a body portion coupled to the body and a cone portion that tapers from the body portion to a bottom portion of the heat sink, the light emitting diode supported on the bottom portion of the heat sink;

a frustoconically-shaped lens coupled to the body and surrounding the lighting unit, the frustoconically-shaped lens including a top portion, a middle portion, and a flat bottom, the top portion completely surrounds the heat sink and is coupled to the body, the middle portion tapers from the top portion to the flat bottom;

a terminal block supported by the body within the interior cavity, the terminal block configured to connect to a power source and provide electrical energy to the lighting unit to illuminate the light emitting diode; and a hanging cable configured to hang the body from a support structure.

* * * * *